US010625145B2

(12) United States Patent
Long

(10) Patent No.: US 10,625,145 B2
(45) Date of Patent: Apr. 21, 2020

(54) SPORTS-INSPIRED DART GAMES

(71) Applicant: Robert A. Long, Parker, CO (US)

(72) Inventor: Robert A. Long, Parker, CO (US)

( * ) Notice: Subject to any disclaimer, the term of this patent is extended or adjusted under 35 U.S.C. 154(b) by 0 days.

(21) Appl. No.: 16/383,901

(22) Filed: Apr. 15, 2019

(65) Prior Publication Data

US 2019/0314713 A1 Oct. 17, 2019

Related U.S. Application Data

(60) Provisional application No. 62/657,059, filed on Apr. 13, 2018.

(51) Int. Cl.

| | |
|---|---|
| ***F41J 3/00*** | (2006.01) |
| ***A63F 3/00*** | (2006.01) |
| ***A63F 9/02*** | (2006.01) |

(52) U.S. Cl.

CPC ..... *A63F 3/00056* (2013.01); *A63F 9/0208* (2013.01); *F41J 3/0076* (2013.01); *A63F 2009/0221* (2013.01)

(58) Field of Classification Search

CPC .. F41J 3/0076; F41J 3/00; F41J 3/0071; F41J 3/0066

USPC ..... 273/371, 403, 408

See application file for complete search history.

(56) References Cited

U.S. PATENT DOCUMENTS

| | | | | |
|---|---|---|---|---|
| 2,227,382 A | | 12/1940 | Salter et al. | |
| 3,979,117 A | | 9/1976 | Worsham | |
| D251,025 S | | 2/1979 | Taylor | |
| D257,482 S | | 11/1980 | Leduc | |
| D285,942 S | | 9/1986 | Kemmeter | |
| 4,681,325 A | | 7/1987 | Sheem | |
| D293,455 S | | 12/1987 | Caplan | |
| 4,893,822 A | | 1/1990 | Tessa | |
| 5,553,850 A | * | 9/1996 | Savu | A63F 3/0005 273/317.2 |
| 5,558,337 A | | 9/1996 | Frank | |
| 5,613,684 A | * | 3/1997 | Gittens | F41J 3/0057 273/348.3 |
| 5,642,886 A | | 7/1997 | Yancey, Jr. | |
| 5,664,782 A | | 9/1997 | Lacks | |
| 5,967,518 A | * | 10/1999 | Rowe | F41J 3/0076 273/317.5 |
| 6,116,605 A | * | 9/2000 | Davey, III | A63F 9/02 273/317.1 |
| D444,505 S | | 7/2001 | McGinnis | |
| 6,402,154 B1 | | 6/2002 | Hess | |
| 7,275,747 B1 | * | 10/2007 | Tanita | F41J 3/0076 273/408 |

(Continued)

FOREIGN PATENT DOCUMENTS

| | | | | |
|---|---|---|---|---|
| GB | 2194740 A | * | 3/1988 | F41J 3/0076 |
| WO | 2013070092 | | 5/2013 | |

*Primary Examiner* — Mark S Graham

(74) *Attorney, Agent, or Firm* — Leyendecker & Lemire, LLC

(57) ABSTRACT

A sports-inspired dart game and method of playing the dart game are described. Embodiments of the sports-inspired dart game can include, but are not limited to, a dart board including indicia of a field of play, a mat including distance markers from which players throw darts, and a plurality of game pieces removably coupled to the dart board and implemented as targets and anti-targets on the dart board. Different rules can be implemented for a particular sports-inspired game being played.

11 Claims, 8 Drawing Sheets

(56) References Cited

U.S. PATENT DOCUMENTS

| | | | |
|---|---|---|---|
| 7,806,409 | B1 | 10/2010 | Cardenas |
| 7,992,874 | B1 | 8/2011 | Davidson |
| D764,596 | S | 8/2016 | Smith |
| 2005/0062232 | A1 | 3/2005 | Pavlik |
| 2011/0049808 | A1 | 3/2011 | Curcija |
| 2012/0200042 | A1 | 8/2012 | Kelly |

* cited by examiner

SPORTS-INSPIRED DART GAMES

CROSS-REFERENCE TO RELATED APPLICATION

This application claims the benefit of U.S. Provisional Application No. 62/657,059, filed Apr. 13, 2018.

BACKGROUND

The sport of darts, which comprises throwing darts at a circular dartboard, has been around for over 150 years. The board has remained largely the same for much, if not all, of this time although many different games have been created using the standard board. Most dartboards are circular and include a surface for receiving a dart tip therein. Most games involve trying to hit targets defined on the dart board that remain stationary. Further, most current dart board games involve throwing from a set distance that remains the same throughout the game.

DETAILED DESCRIPTION

Figure 1:
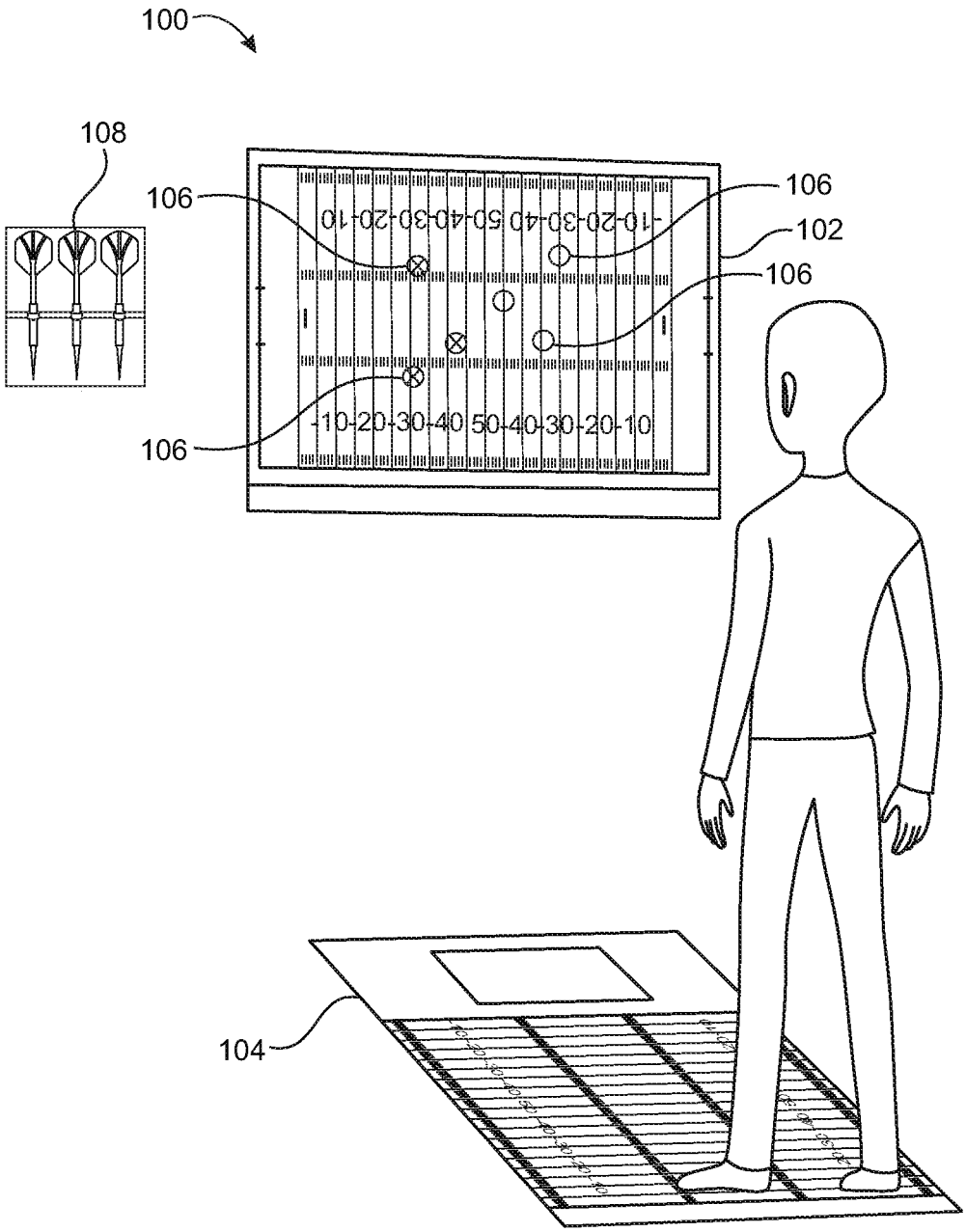
FIG. 1 is a detailed diagram of a sports-inspired dart game system according to one embodiment of the present invention.

Embodiments of the present invention include a sports-inspired dart board, mat, darts, and one or more game pieces. The game pieces can be implemented by both the "offense" and the "defense" to define an offensive or defensive position on the dart board. Offensive game pieces can define a target area for the offensive player and the defensive game pieces can define an area to avoid by the offensive player. Varying actions can take place depending on where the offensive player throws their darts on the dart board.

Typically, each sport-inspired dart board game can include a dart board specifically configured to resemble a field of play. Fields of play can include a football field, a basketball court, a soccer field, a hockey rink or a plurality of other sports that inspired a specific game. For instance, for a football-inspired dart game, the dart board can resemble a football field.

Additionally, each sport-inspired dart board game can include a mat (or runner) that resembles part of the field, court, or rink. For instance, the football-inspired dart game can include a runner that includes distance (e.g., yardage) markers. The various markers and/or regions defined on the mat indicate positions from which a player may throw a dart at the board depending on the requirements of game play. The games may include additional pieces to be placed on the dart board to serve as targets (offensive) or anti-targets (defensive). The anti-targets can define regions on the dart board that if hit by a player throwing a dart may act to benefit an opposing player.

In some embodiments, the games can have time-related aspects, such as requiring a player to throw a dart within a limited amount of time, and for these games a timing device can be provided. In the alternative, the players may provide their own time keeping device.

As mentioned, two or more darts can be provided for each player or the player may use his/her own set of darts. Of significance, the games may require the use of more or less than the traditional three darts used by each player in traditional dart games. For instance, four darts representing four downs can be used in the football-inspired dart game.

Broadly, the invention and embodiments thereof can include a sports-inspired dart game that includes (i) a dart board resembling a sports field, court, or rink with appropriate indicia printed or otherwise represented on the dart board, (ii) a mat, and (iii) game pieces. The mat may resemble at least a portion of a sports field, court, or rink. The mat can be laid on a floor and stood on by a player when throwing a dart. Variations of the game include additional game pieces to be placed on the dart board to create either targets of varying size or anti-targets defining regions that are to be avoided.

Embodiments of the invention may also include the methodology associated with the play of a particular sports-inspired dart game.

The following description pertains primarily to the play of the football-inspired dart game. It is to be understood this disclosure is not limited to a football-inspired game and also includes other sports-inspired games as well as sports-inspired games not specifically described herein that make use of a specialty board and related mat or runner.

In one embodiment, a football-inspired dart game comprises: a rectangular dart board configured to resemble a football field; a mat (or runner) configured to resemble a football field including distance markers for each down and kicking plays; offensive player pieces and defensive player pieces; darts (typically four for each of the home and away players); a rulebook; and an optional game clock/timer.

The football field dart board can include upper and lower (or right and left) hash marks defining an area therebetween; goal lines on each end of the field having predefined line thicknesses; marks at the end of each end zone representing the field goals; boundary lines defining the field; and indicia serving as yard markers. Other than its shape and printed surface indicia, the construction of the dart board may be similar to a traditional dart board. Variations of the board are also contemplated wherein the board is configured as an electronic dart board.

The mat may include a spacer portion that has an end configured to be placed against a wall on which the dart board is hung. The mat can further include 5 different distance markers for use on each of the 4 downs and kicking plays in a typical football game. Football field indicia printed on the mat may not begin for at least several horizontal feet from the location of the board. In one instance, the spacer portion may be printed with advertising or branding indicia. Although wider and longer than the field printed on the dart board, the field printed on the mat can be similar to that of the dart board. In use, the player typically stands at the appropriate distance marker coinciding with a down the player currently has. In one instance, a player can stand further away from the dart board with each sequential down. For instance, a distance for a first down can be shorter than the distance a player must throw from for a second down and so on.

Offensive player pieces comprising rings (or other shapes) that include needled bottom sides of varying perimeters can be provided to serve as targets for the offensive player. These targets can represent wide receivers, tight ends, and running backs. Target pieces representing the receivers can be smaller than those representing the tight ends and the running backs. In some example rules of play, a user may place the receivers further down the field from a line of scrimmage than the tight ends and running backs.

Defensive player pieces may also be provided that also comprise rings (or other shapes) with needled bottoms for placement on the board except the rings can also include and X-shaped top side that may cover some of the open portion of the ring. These pieces representing defensive players can be placed to hinder players from throwing a dart in the region they are placed. If the dart lands in the defensive ring on the board, a turnover can typically be recorded.

In addition to rules for the game, a game clock (or timer) can be provided for use with variations of game play that involve a play clock. Alternatively, in variations of the game requiring time management, a household clock or a watch can be used.

In one embodiment, a football inspire dart game can involve a football field designed dart board and a mat including a throwing marker for 5 different occurrences in a typical football game. The throwing markers may represent kicking situations, first down, second down, third down, and fourth down. Typically, a distance from the dart board can be elongated with each marker from kicking to fourth down. The players can place game pieces on the dart board representative of different offensive and defensive players. Players can score points by successively throwing darts into the openings of game pieces on the dart board.

In one embodiment, a basketball inspired dart game can typically involve a shot clock wherein the players alternate throwing darts towards their respective targets on the board. The game can also include game piece targets that represent players. The targets are in the form of rings or other shapes having an opening. By shooting from the appropriate distance on the runner and landing the dart on the board within a ringed game piece results in points being scored.

In one embodiment, a hockey inspired dart game can include the placement of game pieces on the dart board representative of hockey players. The players can score by landing darts on the rink-inspired board within the game pieces of their players.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Sports-Inspired Dart Game System

Referring to FIG. 1, a detailed diagram of an embodiment 100 of a sports-inspired dart game system is illustrated. The sports-inspired dart game system 100 can include components specifically designed for a particular game. For instance, a football-inspired game may include a football field shaped and marked dart board. In another instance, a basketball-inspired game may include a basketball court shaped and marked dart board.

As shown, the sports-inspired dart game system 100 can include, but is not limited to, a dart board 102, a mat (or runner) 104, a plurality of game pieces 106, and a plurality of darts 108. A player is shown standing on the mat 104 ready to throw one of the darts 108 at the dart board 102.

The dart board 102 can typically be constructed similar to known dart boards. However, depending on the type of sport the sports-inspired dart game system 100 is based on, the dart board 102 may have different configurations. For instance, for a football-inspired game, the dart board 102 can have a substantially rectangular shape and include indicia mimicking a football field. In another instance, for a hockey-inspired game, the dart-board 102 can have a substantially stadium shape and include indicia mimicking a professional hockey ice rink.

Figure 2A:
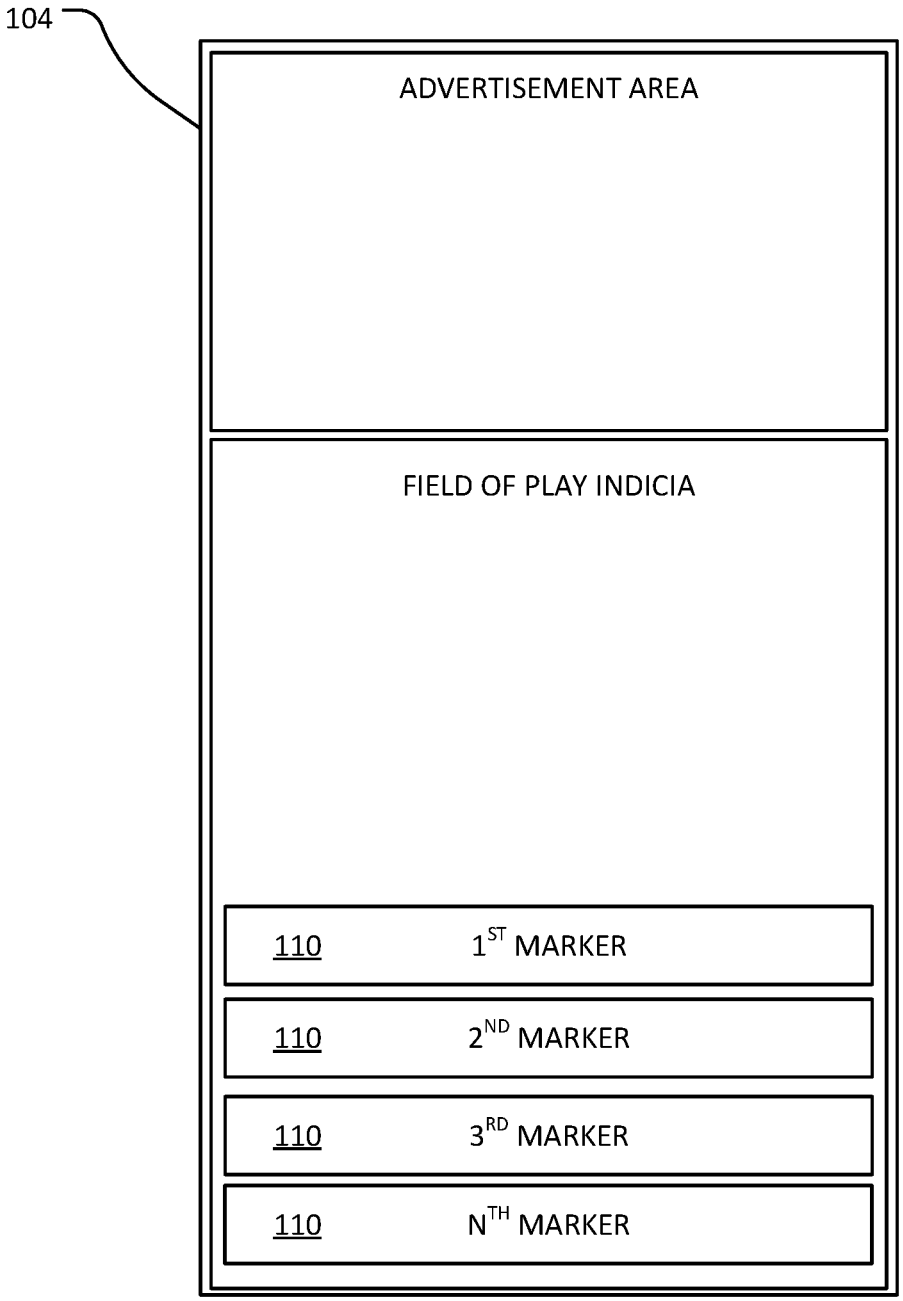
FIG. 2A is a top view of a mat according to one embodiment of the present invention.

Referring to FIG. 2A, a top view of the mat 104 is illustrated. The mat 104 can be implemented to provide distance markers from which a player must throw during a game. Typically, the mat 104 can include a first end that is placed against a wall the dart board 102 is attached to. The second end of the mat 104 can extend out and away from the wall. Generally, the mat 104 can be divided into an "Advertisement" area and a "Field of Play" area.

The mat 104 can include two or more markers 110 (or throwing positions) approximate the second end of the mat 104. The markers 110 can be implemented to denote where players throw darts from when playing a sports-inspired game. The number of markers 110 and a location of the markers 110 can be based on a game being played. Referring back to FIG. 1, the mat 104 is shown with indicia of a football field for the field of play.

Figure 2B:
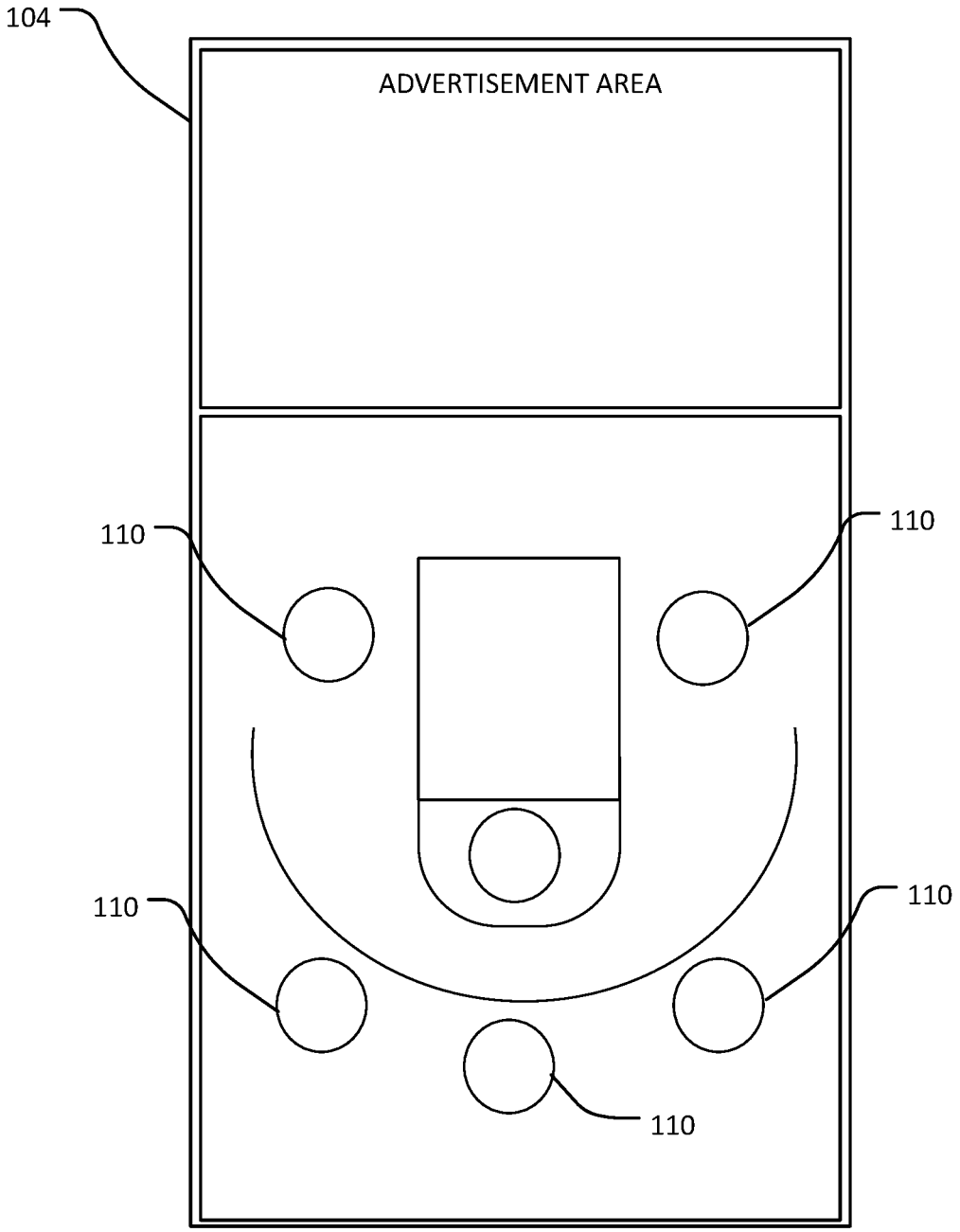
FIG. 2B is a top view of a mat according to one embodiment of the present invention.

Referring to FIG. 2B, a top view of the mat 104 is illustrated with indicia of a basketball court for the field of play. As shown, the markers 110 can be located around a half of a typical basketball court.

Figure 2C:
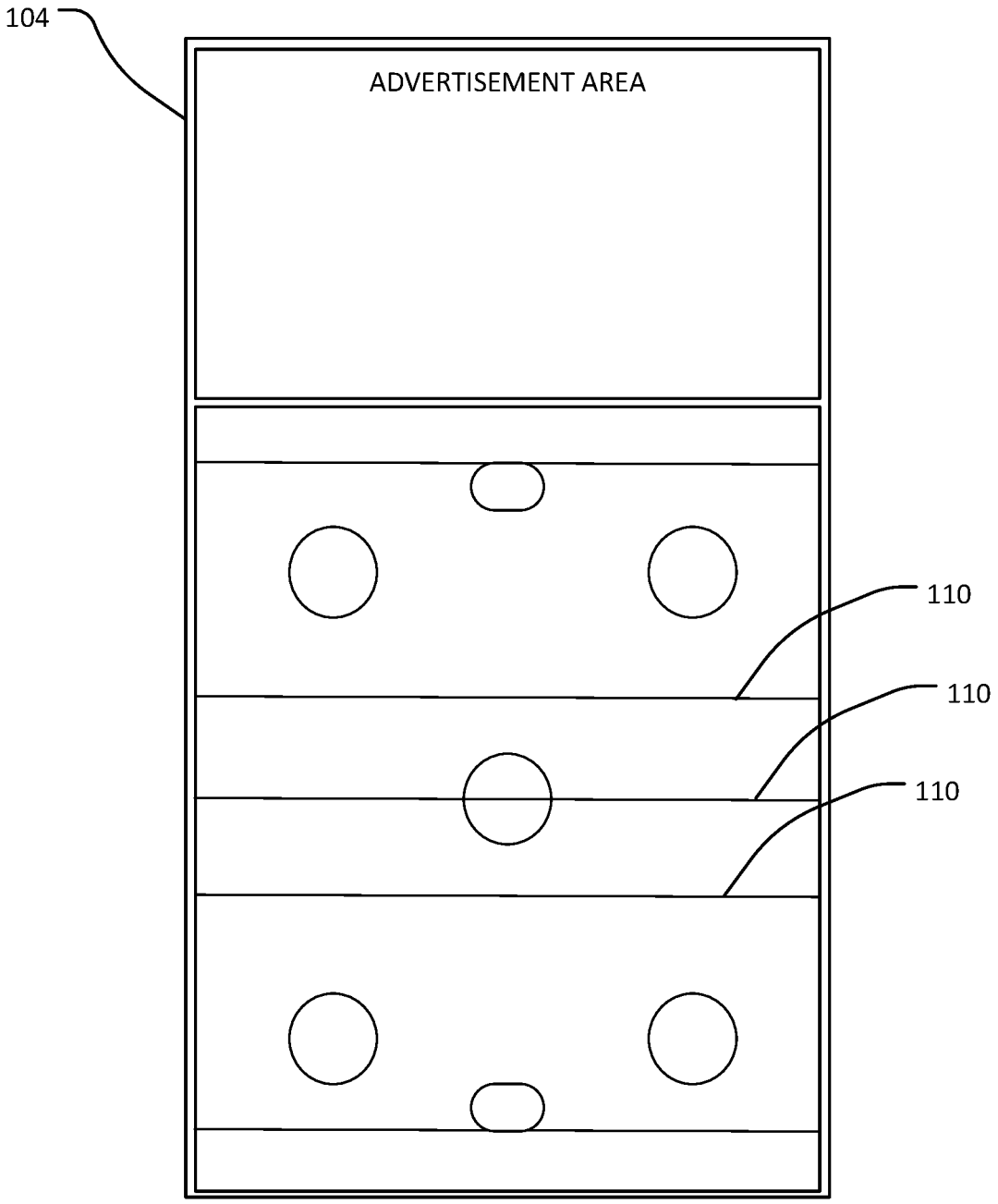
FIG. 2C is a top view of a mat according to one embodiment of the present invention.

Referring to FIG. 2C, a top view of the mat 104 is illustrated with indicia of a hockey rink for the field of play. The markers 110 can be represented by a center line and two blue lines of a typical hockey rink.

The plurality of game pieces 106 can be implemented to provide targets and areas to avoid for players on offense. The game pieces 106 used as targets can be placed by the players on offense and the game pieces 106 used as areas to avoid can be placed by players on defense. As can be appreciated, depending on the type of sport the sports-inspired dart game system 100 is based on, the number and size of the plurality of game pieces 106 can change from sport to sport. Typically, each of the game pieces 106 can include a means for coupling to the dart board 102. In one instance, the game pieces 106 can include protrusions (e.g., needle) extending from a bottom of the game piece to insert into the dart board 102. In another instance, the game pieces 16 can include a magnet on a backside of the game piece for attachment to the dart board 102. It is to be appreciated that other means of coupling the game pieces 106 are contemplated and not outside a scope of the present invention.

Figure 3A:
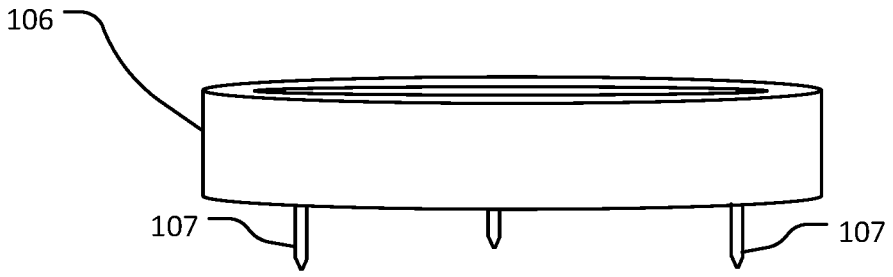
FIGS. 3A-3E include several views of game pieces according to one embodiment of the present invention.
Figure 3E:
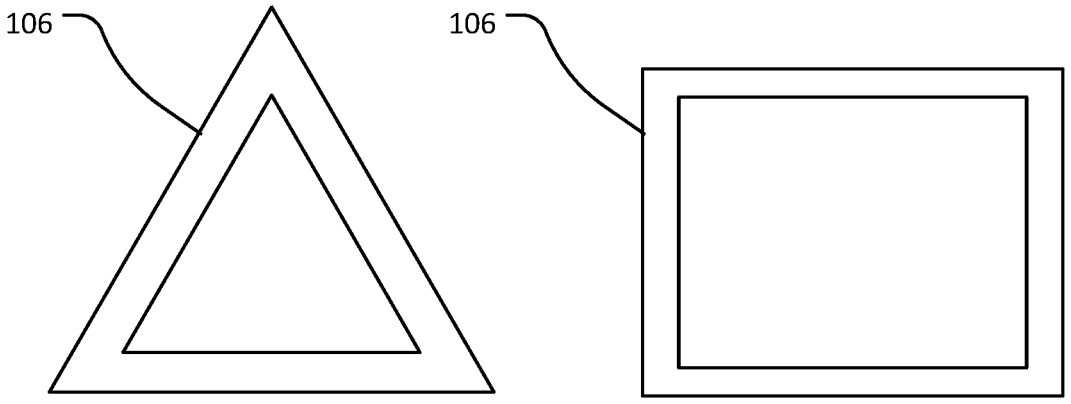
Figure 3B:
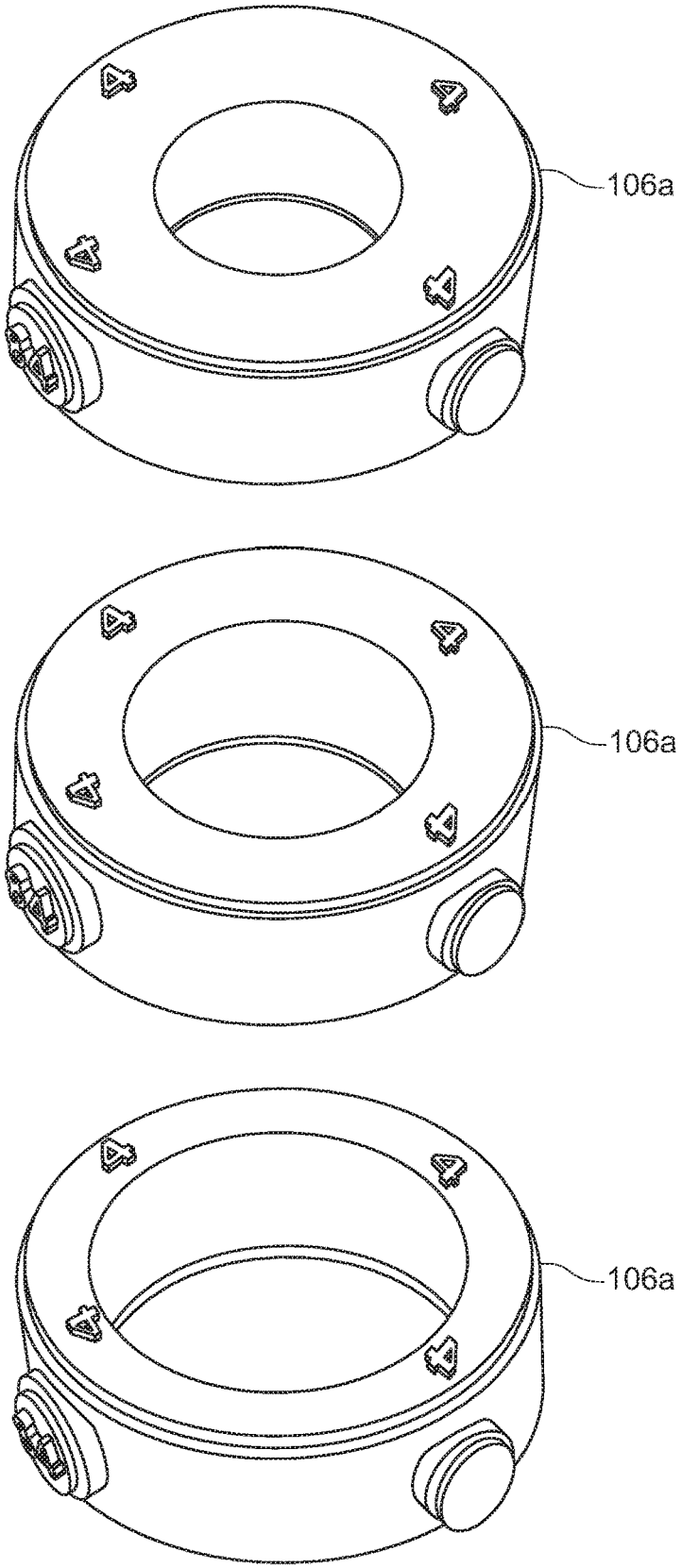

Referring to FIGS. 3A-3E, detailed diagrams of example embodiments of the plurality of game pieces 106 are illustrated. As shown generally in FIGS. 3A-3E, the plurality of game pieces 106 can be broken up into offensive game pieces 106*a* and defensive game pieces 106*b*. FIGS. 3B and 3E include detailed diagrams of different offensive game pieces 106*a* and FIGS. 3C and 3D include detailed diagrams of different types of defensive game pieces 106*b*. Of note, the game pieces 106 shown in FIG. 3E may be implemented as offensive game pieces 106*a* or defensive game pieces 106*b*.

Referring to FIG. 3A, a side perspective view of a game piece 106 is illustrated. Generally, the game pieces 106 can be defined by a hollow cylinder having an outside diameter and an interior diameter. In some instances, the game pieces 106 can have different exterior diameters and/or interior diameters, as will be discussed hereinafter. As shown, each of the plurality of game pieces 106 can include a protrusion 107 (e.g., needle) for removably coupling the game pieces 106 to the dart board 102. Typically, the protrusion 107 can be similar to an end of a dart. In another embodiment, each of the game pieces 106 can include a magnetic strip attached to the game piece 106 to removably couple the game piece 106 to the dart board 102.

Referring to FIG. 3B, a plurality of offensive game pieces 106*a* are shown. In some embodiments, the offensive game pieces 106*a* can have various sized diameters and/or openings. For instance, a first sub-set of offensive game pieces 106*a* may have a first exterior diameter, a second sub-set of offensive game pieces 106*a* may have a second exterior diameter, and both sub-sets of offensive game pieces can have the same interior diameter. In one example, the first exterior diameter can be larger than the second exterior diameter. In another instance, the offensive game pieces 106 can have the same exterior diameter but different interior diameters. As can be appreciated, the rules may allow for different actions based on which offensive game piece 106*a* a player hits based on the size of the opening of the game piece 106*a*. In one example, in a football-inspired game, various offensive positions (e.g., wide receiver, tight end, running back) can have differently sized openings making it easier or harder to hit the intended game piece.

Figure 3C:
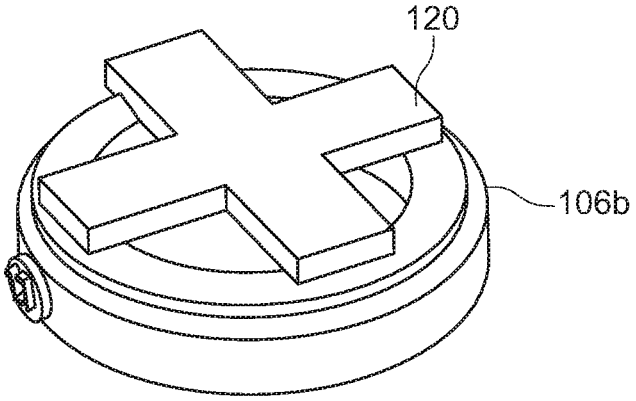
Figure 3D:
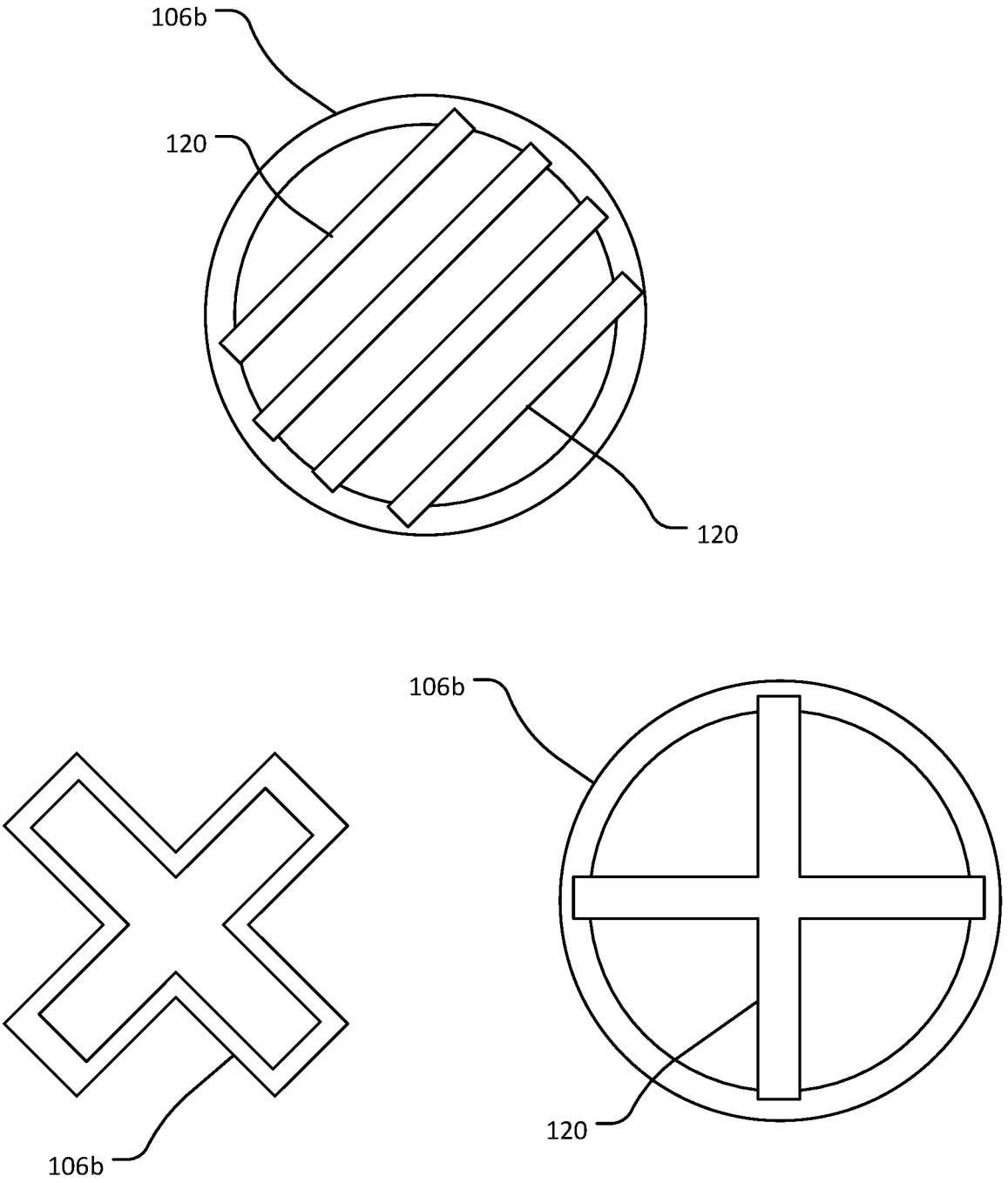

Referring to FIG. 3C, a perspective view of a defensive game piece 106*b* is shown. Referring to FIG. 3D, top views of different defensive game pieces 106*b* are shown. The defensive game pieces 106*b* can generally have a similar shape to the offensive game pieces 106*b* but include a member 120 to create a partial covering of an opening of the defensive game piece 106*b*. As shown in FIG. 3B, the defensive game piece 106*b* can include an "X" shaped member 120 that can cover a portion of the opening leaving small openings in the game piece 106*b*. In some instances, an offensive player that throws a dart that lands in an opening of the defensive game piece 106*b* may record a turnover or some other negative impact to the player throwing the dart.

As shown in FIG. 3D, a top view of the "X" shaped member 120 on the defensive game piece 106*b* is illustrated. Another example defensive game piece 106*b* with multiple members 120 cover a portion of the opening of the game piece 106*b* is shown. In yet another example, the defensive game piece 106*b* may be a substantially "X" shaped tube. It is to be appreciated that the examples provided are for illustrative purposes and not meant to be limiting.

Referring to FIG. 3E, a plurality of different shapes for the offensive game pieces 106*a* and the defensive game pieces 106*b* are illustrated. In one embodiment, the game pieces 106 can be manufactured to have a substantially square tubular shape. The square tubular game pieces can include protrusions on a backside to removably couple to the dart board 102. In another embodiment, the game pieces 106 can be manufactured to have a substantially triangle tubular shape. In some instances, the square game pieces can include no covering. In other instances, the square game pieces can include coverings similar to the previously described defensive game pieces 106*b*. It is to be appreciated that other shapes and designs are contemplated and not outside a scope of the present invention.

The plurality of darts 108 can be similar to darts currently available. Depending on the sport the sports-inspired dart game system 100 is based on, the number of darts 108 may vary from game to game. In some embodiments, players may provide their own darts.

Referring to Table 1 below, example game instructions for 3 different sports-inspired dart games are described. It is to be appreciated that the described game instructions are but examples and not meant to be limiting. The game instructions described below can be used in combination with the sports-inspired dart game system 100. Of note, the term "target" as referenced in Table 1, refers to the game pieces 106.

TABLE 1

| Game Rules | Dart QB | Dart Madness | Dart Ice |
|---|---|---|---|
| Players | 2 to 4 | 2 to 4 | 2 to 4 |
| Position play | 2 Player: Dart QB is the player Shooting the Dart and is also the OC.<br>4 players: Dart QB throws and the OC arranges the players and target routes. | 2 Player: Shooting guard makes all the passes and places all the players.<br>4 Player: Shooting guard pass/shoots and the Coach places players and targets. | 2 Player: The Winger places all players on the Arena<br>4 Player: Winger pass/shoots and the Coach places Offense and Defense Targets |
| Floor Lines (Markers 110) | There are 5 Lines you stand behind to throw based on Position.<br>Kicking is closest at 7'6" from the field.<br>1st Down is 8 ft<br>2nd is 8'6"<br>3rd is 9'<br>4th is 9'6" from the field | There are 3 Lines the 2 players will be standing behind: You will be from the Pass/shoot line at 8 ft from the Court Board.<br>The Dunk line is 7 ft and is only after you have connected to a Player inside the paint.<br>3 Point Arc 9 ft is if you choose to shoot 3-point w/o assist only. You would shoot from the PASS/Shoot line if you connected on a player outside the ARC. This is the only time the Pass/shoot line allows 3 points for the distance to the basket. | There are 2 Lines for the 2 players pass/shooting. The red line is 9' 6" from the arena board. All players will pass shoot from here. If you complete and "Pass" to a target. You can shoot form the Attacking zone line 7 ft and try to score a goal. You can always try to score from the Red line. The object is to get closer by a "Pass" and elevate your accuracy. |
| Starting the Game | Flip a coin choose a side to Receive. If you want to start as Defense the other player chooses the Direction for their offense. Kickoff: The kicker will try to land the dart in field but not in the End Zone. Closer to the EZ the better. Offensive Dart QB starts from there, or the 35 if the Dart lands in the Endzone | Each Player from behind the Floor Line throws a Dart closest to Center Court. Player wins and starts offense first. Each Half starts the same. | Each Player from behind the Floor Line throws a Dart closest to Center Ice. Player wins and starts offense first. Each period starts the same. |
| Time play per throws:<br>Target Values (Game Pieces 106/106a/106b) | 2 Minutes to score a TD/FG<br>WR = 40 Yards<br>RB = 30 Yards<br>TE = 20 Yards | 1 Minute Alternating between 2 Players<br>Guard = 4<br>Forward = 3<br>Center = 2 | 1 Minute Alternating between 2 Players<br>Offensive players are smaller and cannot be in the opposing teams Goalie Box<br>The defensive players cannot be "defending" in their own goalie box |
| Place your Targets (Game Pieces 106/106a/106b) | 30 Seconds to place offensive/defensive targets. No change till a completion. The target receivers must be placed within their specific yardage from the line of scrimmage. The players on the field may be: 1 WR 1 RB 1 TE; 2 RB 1 TE; 2 TE 1 RB; 2WR The RCVRS value is counted as a Points per Reception (PPR) league | 30 Seconds to place offensive/defensive targets. No changes till the Qtr. has ended. Only 1 Center can play. | 30 Seconds to place offensive/defensive targets. No changes till the Period has ended. |
| Offensive possession | Dart QB begins from the Line of scrimmage. Throws | The Coach places the 4 Target players on the Board. The same for the | The Coach places the 5 Target players on the Arena NO |

TABLE 1-continued

| Game Rules | Dart QB | Dart Madness | Dart Ice |
|---|---|---|---|
| | darts to connect to any receiver. If a dart lands in the Receiver the Dart QB or Offensive Coordinator (OC) can move the Receivers "up" the field for their new Routes. 2 Minutes to "move" up the field and score. You get a first down on a "Catch". Another 4 Darts to do get another catch. Catch in the EZ or 2 minutes expire ends the possession. | other team. You can place any player on the opposing team courtside not in the Basket for offense. You may defend your side with any player(s). The shooting Dart Guard (YOU) on the Floor must be behind the Pass/Shoot Line. You can "Shoot" and if the Dart lands in the "Basket" its Points. If it's a pass to a player Target and lands in any, you can shoot again, to the basket or another target player. The points are then multiplied by the Targets point value, If you do not get a catch/basket, its the other players turn, Alternate between shooters, till a catch/basket connects. 1 minute of alternating pass/shooting. | Goalie. 2 Defensive game pieces placed on the other teams side, and 3 offensive game pieces. The same for the other team. The shooting Dart Winger on the Floor must be behind the Pass/Shoot Line. You can "Shoot" and if the Dart lands in the "Goal" its Points. If you pass to a player Target and lands in any, you can shoot again, to the goal or another target player. If you connect on the Puck pass the "Field Winger"(YOU) move closer from the Floor line to the Arena (Board). If you do not get a connect or score a goal, it's the other players turn. Alternate between shooters, till a pass/goal shot connects. 1 minute of alternating pass/goal shot. |
| Defensive Possession | After the offense adds the RCVRs to the Board, Defensive players are added. 30 seconds to defend in position. You have 3 Players to place. You can change if offense makes a Catch. IF the offense chooses not to change their Routes, defense cannot change unless they call 30 second timeout. | 30 seconds to place your Defensive players. They don't change for the entire QTR | 30 seconds to place your Defensive players. They don't change for the entire Period |
| Counting your points | Scoring is done by connecting to a Rcvr in the EZ (6 points) Kicking an extra point after scoring (1 point) or trying a 2 point conversion (2 points). Kicking a field Goal (3points) The score is by these points only. RCVR yardage is on a tallying statistic including Interceptions, Touchdowns etc. | Scoring is done by baskets made. If passes are "completed" the value of the target is multiplied by the basket if made. If a "Center" catches the pass and a Dunk is made, the points accrued are four points. 2 for the value of the Center and 2 points for the Basket. If a pass is made to a "Guard" the value is 4 and if the Guard is "BEHIND" the Arc then if the Basket is made then its 12 points (4 × 3 Points) The basket must be made to get the Total points. If a pass is made and the basket is | Scoring is made by only making the Goal. You can shoot for the goal, but you will always be beyond the Red Line on the floor to shoot the dart. (Farthest from the Board) The object is always to complete a pass for a Target so then you move closer to the Goal. The player target you hit that is closer to the opposing team's goal, allows you to be closer on the floor line to shoot a goal. If no passes are completed your |

TABLE 1-continued

| Game Rules | Dart QB | Dart Madness | Dart Ice |
|---|---|---|---|
| | | missed, this equals 0. Statistics can be made on Points from Guards/Forward/Center; Dunks; 3 pointers etc. | challenge is always with distance toward your own goal. Complete a pass and move closer to have a more accurate shot just like a hockey game is Low scoring. |
| Count your Points and Stats | Interceptions<br>Touchdowns<br>Field Goals<br>Penalties<br>Completions<br>Yardage | Assists<br>Dunks<br>3 Pointers (with or w/o pass)<br>Turnovers<br>Field Goals (Points w/o passing) | Assists<br>Goals (with or w/o assists<br>Defended Turnovers |
| Clock Time per game | 24 Minutes/4-6 Minute Qtrs. | 20 Minutes/4-5 Minute Qtrs. | 18 Minutes/3-6 Minute Periods |
| Players on the floor field/court/arena at a time: | 1 Player throws from the line | 2 Players on the line Throw alternately | 2 Players on the line Throw alternately |
| Consecutive throws: | Up to 4 | 1 throw. Must complete a pass to throw again and take a basket shot. Other player does the same | 1 throw. Must complete a pass to throw again and take a goalie shot. Other player does the same |
| To get more throws "Plays" you must: | Connect with RCVRs/First Down Or Score | Connect or score | Connect or score |
| Possession Change | You do not connect for a pass on any of your 4 downs. Or you don't score in 2 minutes. | You don't connect for a PASS or BASKET | You don't connect for a PASS or GOAL |
| At end Quarter/Period | Change sides. | Change sides | Change sides |
| Penalties happen when: | Out of Bounds; Dart doesn't Land or falls off the board; Incorrect Receiver yardage. Loss of Down | Out of Bounds; Dart doesn't land or falls off board A Free Dunk | Out of Bounds; Dart doesn't land or falls off board. A Free SHOT |
| Between possessions | 15 seconds to Collect Darts each team. Realign Rcvrs another 30 seconds | 15 seconds to collect darts for each team | 15 seconds to collect darts for each team |
| Changing Targets | After each possession 30 seconds for each team | After each Qtr. | After each Period |
| Time outs | 2 per team per half 30 seconds each | 2 per team per half 30 seconds each | 3 total per team 30 seconds each |
| Play should be similar to the sport | It's a process of learning play style, strategies and becoming an accurate dart player with a Football game process. | It's a process of learning play style, strategies and becoming an accurate dart player with a Basketball game process. | It's a process of learning play style, strategies and becoming an accurate dart player with a Hockey game process. |
| In case of Tie at the end of Regulation (Overtime) | Begins as new game/Coin flip etc. First team to score a touchdown or a field goal with each team having a possession wins. 5 minutes of play clock. 1 timeout each. May end in tie. | Start new (5th) Quarter. Play for (2) one-minute alternating play. Highest scoring wins. Add another (2) one-minute plays to break ties. | Start a new Period. 3 Minutes to score. First to score wins. May end in Tie |
| Rules can be changed by The Commissioner of the League | Voted by Team Owners | Voted by Team Owners | Voted by Team Owners |

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A dart board game for two or more players comprising:

a dart board including indicia of a field of play, the dart board being hung on a wall;

a mat including indicia of the field of play and having a first end placed proximate the wall the dart board is hung on, a second end of the mat including:

a first distance marker;

a second distance marker; and a third distance marker;

a plurality of offensive games pieces adapted to be removably coupled to the dart board, the plurality of offensive game pieces each being defined by:

a hollow cylinder; and at least one protrusion extending from a face of the hollow cylinder;

a plurality of defensive game pieces adapted to be removably coupled to the dart board, the plurality of defensive game pieces each being defined by:

a hollow cylinder;

at least a portion of an opening of the hollow cylinder being covered on a first face of the hollow cylinder; and at least one protrusion extending from a second face of the hollow cylinder;

instructions, the instructions detailing how to play the game.

2. The dart board game of claim 1, wherein (i) the plurality of offensive game pieces include (a) at least one offensive game piece having a first interior diameter, and (b) at least one offensive game piece having a second interior diameter, and (ii) the first interior diameter is bigger than the second interior diameter.

3. The dart board game of claim 1, wherein (i) the dart board has a substantially rectangular shape; (ii) the indicia of the field of play resembles a football field; and (iii) the second end of the mat further includes a fourth distance marker and a fifth distance marker.

4. The dart board game of claim 3, wherein (i) first distance marker is used to simulate kicking plays in a game of football; (ii) the second distance marker is used to simulate a first down play in a game of football; (iii) the third distance marker is used to simulate a second down play in a game of football; (iv) the fourth distance marker is used to simulate a third down play in a game of football; and (v) the fifth distance marker is used to simulate a fourth down play in a game of football.

5. The dart board game of claim 1, wherein the indicia of the field of play on the dart board defines a playing area on the dart board.

6. A dart board game for two or more players comprising:

a dart board including indicia resembling a field of play, the dart board adapted to be hung on a wall;

a mat having a first end and a second end, the first end adapted to be placed proximate the wall the dart board is hung on and the second end including a plurality of markers;

a set of first game pieces each having a structure defined by:

a hollow cylinder; and at least one protrusion extending from a face of the hollow cylinder, the at least one protrusion removably coupling the first game piece to the dart board;

a set of second game pieces having a structure defined by:

a hollow cylinder;

a member covering at least a portion of an opening on a first face of the hollow cylinder; and at least one protrusion extending from a second face of the hollow cylinder, the at least one protrusion removably coupling the second game piece to the game board.

7. The dart board game of claim 6, wherein the member has a substantially "X" shape.

8. The dart board game of claim 6, wherein the member is removably coupled to the first face of the second game piece.

9. The dart board game of claim 6, wherein the set of first game pieces include (i) at least one first game piece having a first interior diameter, and (ii) at least one first game piece having a second interior diameter.

10. The dart board game of claim 9, wherein the first interior diameter is bigger than the second interior diameter.

11. The dart board game of claim 6, wherein the dart board game further includes instructions detailing how to play the game, the instructions including at least the steps of:

a first player coupling each of the first game pieces to the dart board;

a second player coupling each of the second game pieces to the dart board; and the first player throwing one or more darts from a first marker of the plurality of markers.

* * * * *